United States Patent [19]

Black

[11] Patent Number: 4,773,356

[45] Date of Patent: Sep. 27, 1988

[54] LINING A FURNACE WITH A REFRACTORY MATERIAL

[75] Inventor: William B. Black, Bridge of Weir, Scotland

[73] Assignee: W B Black & Sons Limited, Scotland

[21] Appl. No.: 22,040

[22] Filed: Mar. 5, 1987

Related U.S. Application Data

[63] Continuation-in-part of Ser. No. 895,480, Aug. 11, 1986, abandoned.

[30] Foreign Application Priority Data

Jul. 24, 1986 [GB] United Kingdom ..... 8618089
Feb. 18, 1987 [GB] United Kingdom ..... 8703798

[51] Int. Cl.[4] ..... F22B 37/00

[52] U.S. Cl. ..... 122/6 A; 110/264; 110/336; 110/338

[58] Field of Search ..... 110/264, 336, 337, 338, 110/331, 234; 122/6 A

[56] References Cited

U.S. PATENT DOCUMENTS

| | | | |
|---|---|---|---|
| 3,039,406 | 6/1962 | Aref . | |
| 3,771,467 | 11/1973 | Sweet | 110/336 |
| 3,850,146 | 11/1974 | Graham et al. | 122/6 A |
| 4,086,740 | 5/1978 | Ahnett | 110/336 X |
| 4,086,740 | 5/1978 | Annett | 110/336 X |
| 4,241,232 | 12/1980 | Gelsing | 110/336 X |
| 4,473,014 | 9/1984 | Dejanovich | 110/264 |
| 4,539,919 | 9/1985 | Bossetti | 110/331 |
| 4,651,487 | 3/1987 | Nisaikawa | 110/336 X |

FOREIGN PATENT DOCUMENTS

| | | |
|---|---|---|
| 297240 | 9/1928 | United Kingdom . |
| 313875 | 9/1930 | United Kingdom . |
| 347337 | 4/1931 | United Kingdom . |
| 507293 | 6/1939 | United Kingdom . |
| 671391 | 5/1952 | United Kingdom . |
| 790292 | 2/1958 | United Kingdom . |
| 1077901 | 8/1967 | United Kingdom . |
| 1121991 | 7/1968 | United Kingdom . |
| 1230072 | 4/1971 | United Kingdom . |
| 1291402 | 10/1972 | United Kingdom . |
| 1371020 | 10/1974 | United Kingdom . |

*Primary Examiner*—Edward G. Favors
*Attorney, Agent, or Firm*—Gerald J. Ferguson, Jr.

[57] ABSTRACT

A cyclone furnace for a pulverized fuel boiler comprises a casing enclosing a cage of water tubes and having studs extending inwardly from each of the water tubes. Refractory tiles line the inside of the furnace, each fitted over a stud and secured in place thereby protecting the water tubes from the intense corrosion and abrasion. The furnace has three sections in which the design of the tiles vary. In the neck section the joints of the tiles are straight, in the barrel section they are curved and sympathetic to the gas flow and in the re-entrant throat the joints are shiplapped or rebated. Although the tiles may be generally rectangular in all sections, they are preferably hexagonal in the barrel.

8 Claims, 5 Drawing Sheets

LINING A FURNACE WITH A REFRACTORY MATERIAL

This application is a continuation-in-part of U.S. parent application Ser. No. 895,480 filed Aug. 11, 1986, abandoned, which in turn claimed priority from UK Application No. 8618089.

DESCRIPTION

The present invention relates to lining combustion chambers, and more particularly relates to lining with a refractory material a cyclone furnace for a pulverised fuel boiler.

It is well known to protect tubes defining the walls of a boiler or smelting furnace by refractory material. In U.S. Pat. No. 4,241,232 a wall of cooling tubes in an electric steel furnace has an inner insulative lining of monolithic refractory material, held on the tubes by hooks. In U.S. Pat. No. 3,850,146 the refractory lining is insulating rectangular tiles, and the tubes are boiler tubes in the burner region of a boiler furnace. British patent No. 1291402 also discloses a refractory rectangular tile lining, but here the tubes are said to define a flame injection throat for a boiler. The tiles, in this instance, have openings therethrough for mounting them on bolts extending inwardly from the tubes, and a wider recess communicating with the opening for receiving a locking nut. The said recess is then plugged by a monolithic refractory material, but may have a keying configuration (U.S. Pat. No. 4,086,740) for helping anchor said refractory plug. In (for example) British Patent Nos. GB671391 and GB1077901 a bonded arrangement of rectangular refractory tiles is shown within a furnace. There is no teaching, however, that the edges of the tiles should be relieved to be sympathetic to gas flow.

Also in GB No. 121991 (Wilce) and to a lesser extent in U.S. Pat. No. 4,651,487 (Nishikawa) a honeycomb arrangement of rectangular (or cast) refractory tiles are shown within a furnace. The hexagonal tiles are employed in Wilce to strengthen the jointing edges, as compared to perpendicular edges - and the case monolithic lining in a hexagonal framework in Nishikawa is low cost and easy to fit. There is no teaching in either patent that the hexagonal tiles be used to break up the continuous edge along adjacent tiles, so as to mitigate edge erosion.

Furthermore there is no teaching whatsoever of a cyclone furnace comprising a lining of refractory tiles whose fitting is rebated in the throat and straight in the neck end section.

All these disclosures however are general and give little or no teaching as to their suitability for cyclone furnaces as is shown by the present state of the art.

Heretofore, a cyclone furnace has been lined with a refractory material by infilling retaining studs, extending from a cage of water tubes and set at a close pitch, with the refractory material. Such infilling has been by ramming, trowelling or casting, depending on the material used and its consistency. However, this method had several disadvantages - namely, a large number of studs has been required and installation of the refractory lining has been time-consuming and difficult. Furthermore, the temperature gradient following installation had to be controlled for initial curing and it has been difficult to alter the design characteristics of the refractory lining to better suit the variable conditions of the different sectors of the furnace.

The present invention attempts to obviate or mitigate some of the disadvantages of such an infilled refractory lining in a cyclone furnace by using specially fitting refractory tiles, adapted for different sections of the cyclone furnace. Some of the tiles in the aforesaid patents are arranged corner-to-corner in a grid-line pattern.

According to the present invention there is provided:

A cyclone furnace for a pulverised fuel boiler wherein a cage of water tubes is provided with a plurality of heat conductive shaped interfitting refractory tiles;

said cyclone furnace including a neck end, a barrel and a throat;

the refractory tiles in said barrel sections being designed in such a manner that there is no continuous straight edge of adjacent tiles extending circumferentially about said barrel section;

the fitting of the refractory tiles being straight in said neck end and rebated in said throat.

Preferably, the tiles comprise silicon carbide or the like.

In a preferred embodiment studs are provided inwardly extending from some of the water tubes, the tiles being provided with bores for mounting on said studs, and securing means being provided for holding the tiles on the studs.

Preferably each securing means is located within a recess in a tile, said recess being afterwards plugged with a refractory material.

Advantageously the securing means for each tile is a steel washer, a ceramic washer and a nut securing the tile to the stud.

Although the bore may be truly circular along its length, in a preferred embodiment the rear portion of the bores are elongate in cross-section for a lateral tolerance in the stud positioning thus allowing for adjustment of the tile during installation.

The furnace may comprise three sections: a neck-end, a barrel and a re-entrant throat. Although the tiles can be generally rectangular in all sections, preferably they are hexagonal in the barrel, thereby minimising the cumulative straight edges of the tiles which are more prevalent with the rectangular tiles.

Embodiments of the invention will now be described, by way of example only, with reference to the accompanying drawings in which.

Figure 1:
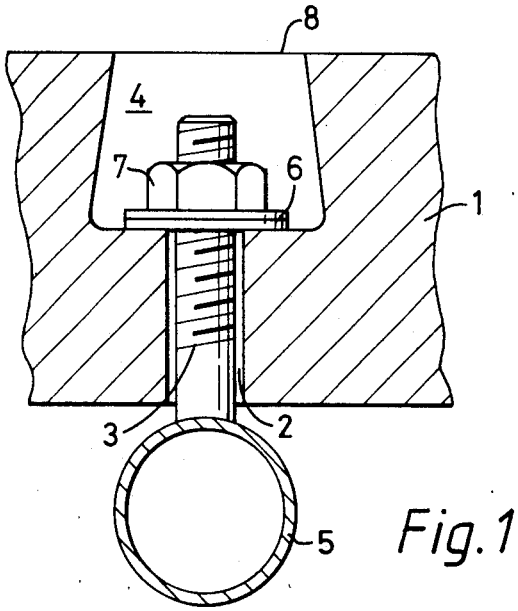
FIG. 1 is a cross-sectional view of a part of a refractory tile fixed by a stud.
Figure 3:
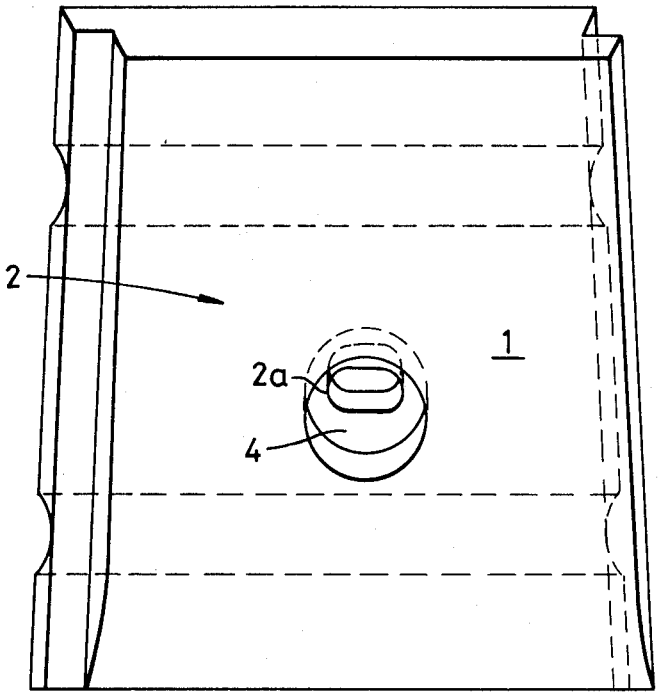
FIG. 3 is a top perspective view of a tile.

Referring to FIG. 1, 1 generally denotes a refractory tile having a bore 2 for reception of a stud 3 and a frusto-conical recess 4 communicating with the bore 2. As shown most clearly in FIG. 3 the rear portion of the bore 2*a* is elongated in cross-section for a lateral tolerance in the stud positioning thus allowing for adjustment of the tile during installation. The stud 3 extends from a water tube 5 in a direction inwardly of a cage 8 (FIG. 5) formed of such water tubes and is secured to the tile 1 by a ceramic fibre washer and steel washer 6 resting on the floor of the recess, and nut 7. The washers 6 and nut 7, when secured, rest within the frusto-conical recess 4 which is then infilled by refractory material thereby forming, when secured, a protective refractory plug (not shown).

Figure 2:
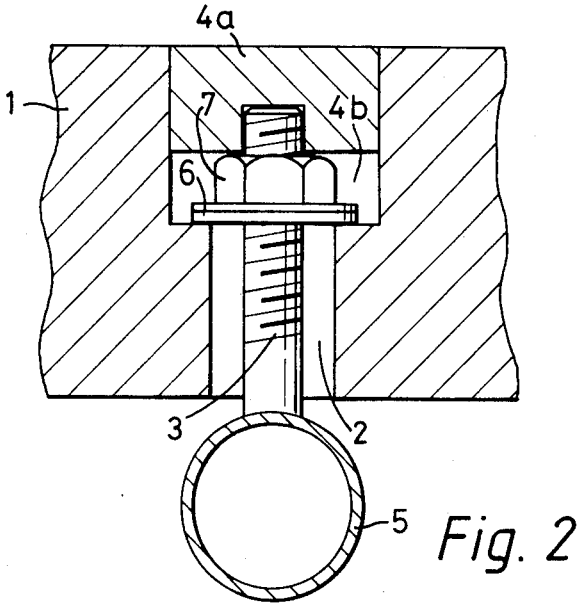
FIG. 2 is a similar view to that of FIG. 1, but incorporating small modifications.

In a preferred embodiment, as shown in FIG. 2, the plug is replaced by a ceramic cap 4a inserted in a cylindrical recess **4*b*, and threadedly engages the top of the stud 3**.

The tubes are embedded in refractory cement, the rear face of the tiles preferably being provided with grooves for retaining the tiles 1 in place.

Figure 5:
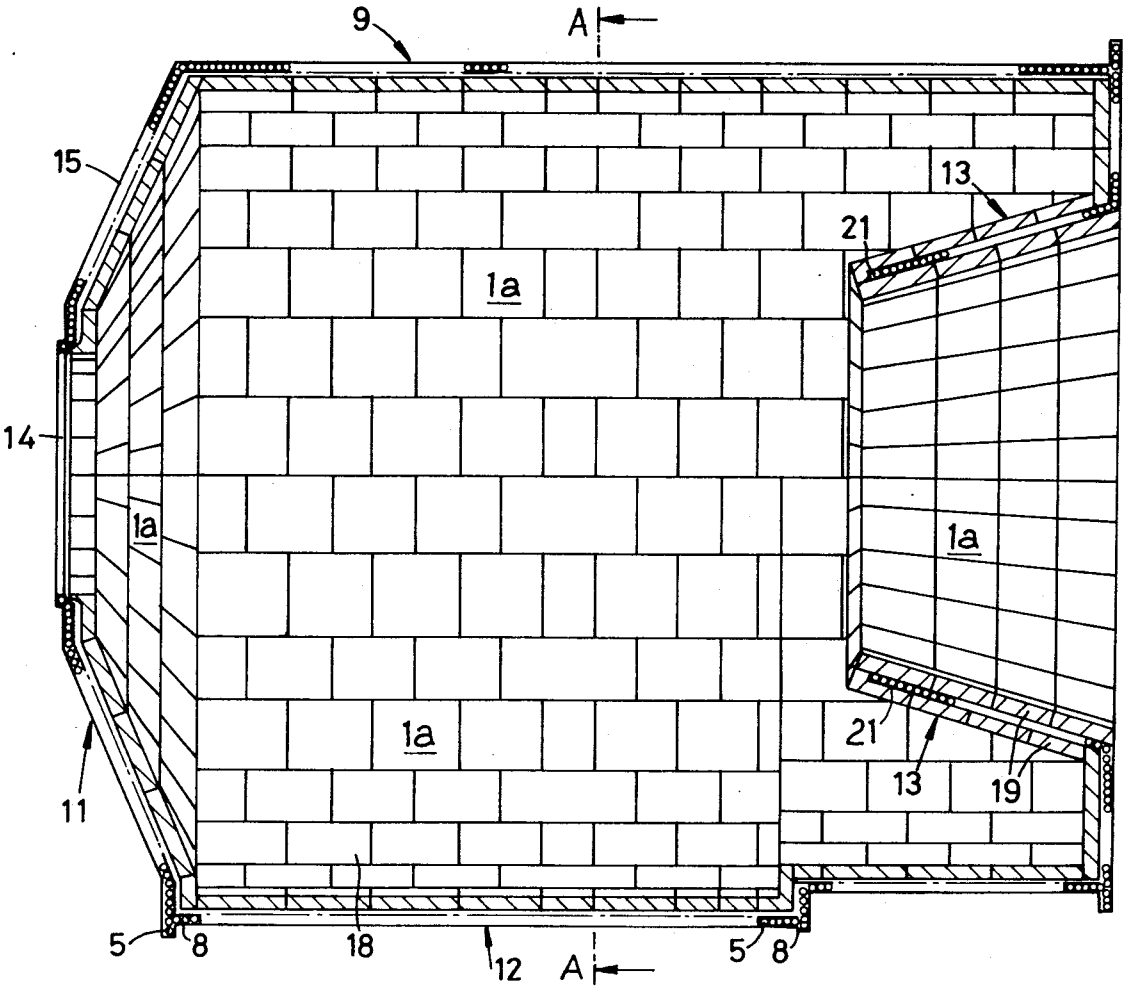
FIG. 5 is an axial-sectional view of a cyclone furnace having a neck-end, a barrel and a re-entrant throat.

A plurality of these fixed tiles 1 line the inside of a cyclone furnace 9 (as shown in FIG. 5) shielding and protecting the water tubes 5 situated within the cyclone furnace 9 from the intense corrosion and abrasion. The refractory tiles 1 must be adapted not only to resist abrasion, but also to provide good heat flow from the combustion products within the furnace to the water tubes 5, and tiles comprising the silicon carbide range of materials are particularly suitable. The cage of water tubes 8 is located within a steel casing (not shown).

Figure 6:
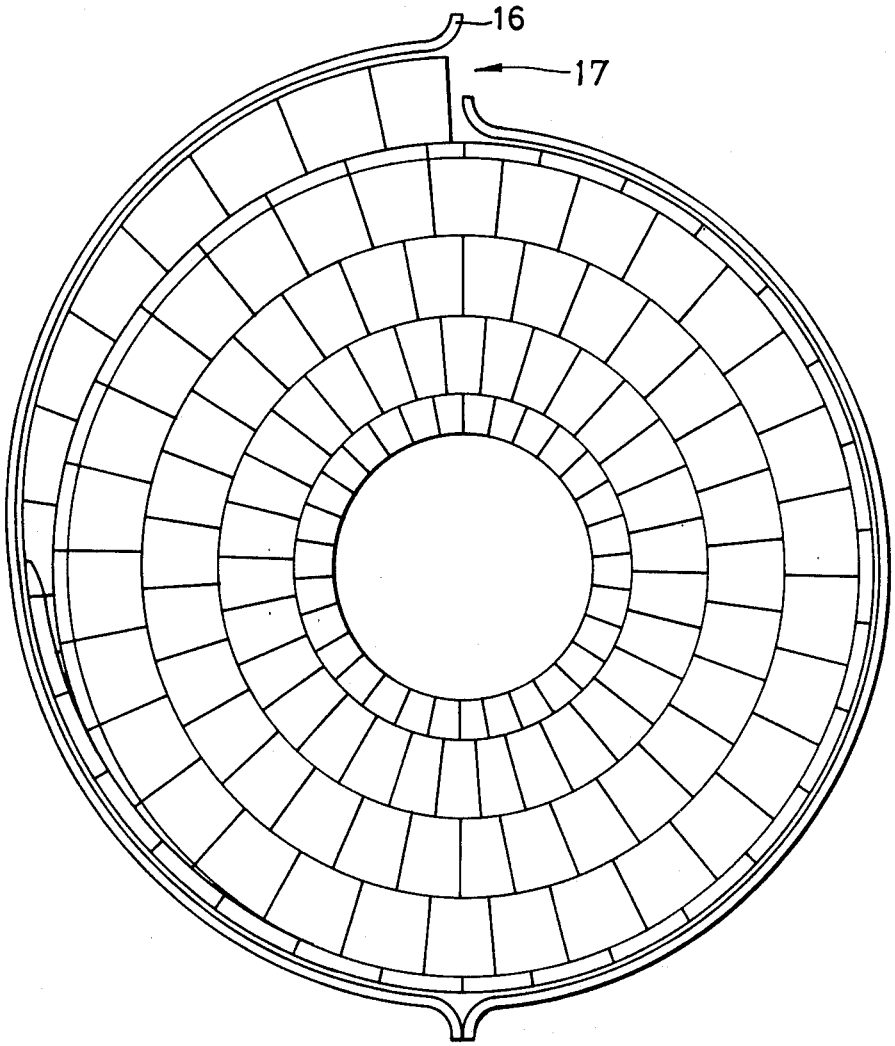
FIG. 6 is a transverse-sectional view on line A—A of FIG. 5.

Referring to FIG. 5, the cyclone furnace 9 comprises three sections: a neck end 11, a main barrel 12 and a re-entrant throat 13. Within these three sections the design characteristics of the refractory tiles vary. The neck end 11 has a circular opening 14 and a truncated cone 15 connecting to the main barrel 12. The main barrel 12 is lined with one type of special blocks, twenty of such blocks being required to complete the circle. In the truncated cone 15 the lining is made up in a series of three rings of special blocks, the inner ring comprising twenty component parts, whereas the mid and outer rings each comprise thirty component parts. Generally the main barrel tile lining 18 is built to a single diameter, but at the scroll section 16, (as shown in FIG. 6) the diameter is increased to allow for a secondary air inlet 17 which is of a tangential nature.

Figure 7:
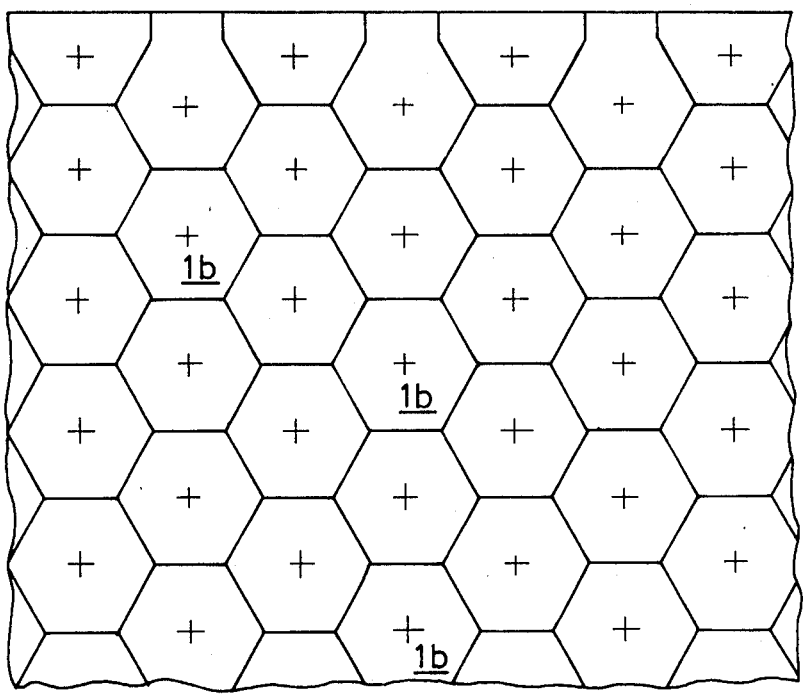
FIG. 7 is an enlarged fragmentary view of the tiles of one embodiment inside the barrel.
Figure 8:
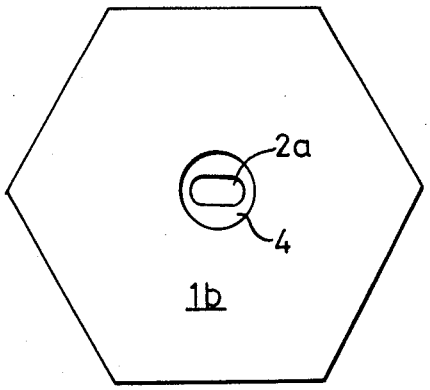
FIG. 8 is a further enlarged view of one of the tiles shown in FIG. 7.

As shown in FIG. 5, the tiles are generally rectangular as defined **1*a*. However, in a preferred embodiment, as shown in FIG. 7, the tiles within the barrel 12 are hexagonal as defined 1*b*, thereby minimising the cumulative straight edges of the tiles which are more prevalent with the rectangular tiles 1*a***, and present more resistant angled tile joints both parallel and at right angles to the incoming erosive pulverised coal. As will the appreciated, the nature of the tile joints will be adapted to the characteristics of the hexagonal shape, and in particular need not specifically be curved as with the rectangular tiles.

The design and setting of the refractory tile arrangement is such that it is of a bonded construction throughout and with the exception of the secondary air inlet 17, which does not require protection other than close proximity welded studding, the refractory tile lining is complete within the barrel section 12. Both sides of the throat tubes 21 forming the re-entrant throat 13 are protected by refractory tiling 19 and the design shows the setting for the tiled scheme on both surfaces where interlocking rebated tiles 20 are applied to give complete protection to the throat tubes 21. The design is such that on both inner 19 and outer 19 surfaces there are four courses of interlocking and interdependent tiles each of which are independently secured by bolted fixings (as shown in FIG. 1) welded to the re-entrant throat tubes 21. Also in this area the re-entrant throat wall is lined with refractory tiling in two courses of tiles each course having thirty component parts, the outer course having provision for a slag spout opening (not shown).

Figure 4:
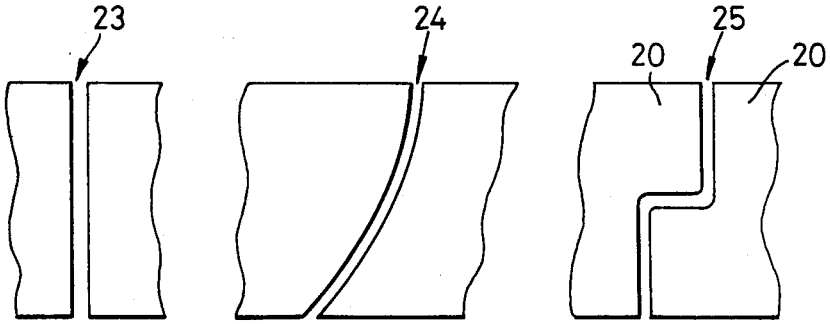
FIG. 4 is a view showing the various joints between the tiles.

Referring now to FIG. 4, in the neck end 11 the neck joints 23 between the tiles are straight and radial. The barrel joints 24, when the tiles are rectangular, are curved and sympathetic to the gas flow (which is of a circular rotating nature) in one direction. Re-entrant throat joints 25 are of a shiplapped and/or rebated type, but on the re-entrant throat wall the tile joints are radial. All joints are filled with a ceramic fibre paper (not shown).

The design principles of the refractory tile lining are such that they apply equally to both clockwise and anti-clockwise firing subject to the correct placement of the barrel joints 24.

The advantages of the present invention over the previous method of lining a cyclone furnace are:

1. It eliminates the need for mass studding;
2. It replaces monolithic linings with high grade refractory tiles purpose made to fit the varying diameters and conical sections of the combustion chamber as an improved quality of refractory lining.
3. It reduces the number of retaining studs as each tile module is secured by one fixing.
4. It simplifies the installation of the refractory linings.
5. It allows for individual tile replacement.
6. It reduces installation time.
7. It economises in maintenance costs arising from easier removal and replacement of unserviceable section(s).
8. It improves design characteristics by producing a lining which conforms to original design criteria.
9. It produces tile module which are pre-fired and therefore do not require initial curing or controlled temperature gradient following. installation.
10. It has spares and replacement parts with unlimited shelf life.

With respect to the barrel tile as shown in FIG. 5, the gas flow is from left to the right hand side of the page.

I claim:

1. A cyclone furnace for a pulverised fuel boiler wherein a cage of water tubes is provided with a plurality of heat conductive shaped interfitting refractory tiles;

said cyclone furnace including a neck end, a barrel and a throat;

the refractory tiles in said barrel section being designed in such a manner that there is no continuous straight edge of adjacent tiles extending circumferentially about said barrel sections;

the fitting of the refractory tiles being straight in said neck end and rebated in said throat.

2. A cyclone furnace according to claim 1 wherein the tiles are rectangular in the barrel section and are arranged in a bonded fashion in courses extending axially of the barrel section.

3. A cyclone furnace according to claim 1 wherein the tiles in the barrel section are hexangonal and arranged in a honeycomb fashion.

4. A cyclone furnace according to claim 2, wherein the barrel section the edges of the tiles which lie axially of the barrel section and which, in use, confront the flow of pulverised fuel in air are relieved so as to be sympathetic to such flow.

5. A cyclone furnace according to the aforementioned claim 1 wherein a plurality of studs are provided extending from some of said water tubes; each of said tiles having an opening therethrough for mounting on one of said studs, and a recess communicating with said opening; a plurality of securing means, each securing means being located in a tile recess for engaging a bolt and securing thereto the corresponding mounted tile; wherein a plurality of ceramic caps are further provided, each cap threadedly engaging a bolt for plugging a tile recess.

6. A cyclone furnace according to the aforementioned claim 5 wherein said tile bores are elongate in cross-section for a lateral tolerance in the stud positioning thus allowing for adjustment of the tile during installation.

7. A furnace comprising a cage of water tubes; a plurality of studs provided extending from some of said water tubes; a lining of interfitting refractory tiles, each of said tiles having an opening therethrough for mounting in one of said studs, and a recess communicating with said opening; a plurality of securing means, each securing means being located in a tile recess for engaging a bolt and securing thereto the corresponding mounted tile; wherein a plurality of ceramic caps are further provided, each cap threadedly engaging a bolt for plugging a tile recess.

8. A furnace according to claim 7 wherein said tile bores are elongate in cross-section for a lateral tolerance in the stud positioning thus allowing for adjustment of the tile during installation.

* * * * *

UNITED STATES PATENT AND TRADEMARK OFFICE

CERTIFICATE OF CORRECTION

PATENT NO. : 4,773,356

DATED : September 27, 1988

INVENTOR(S) : Black

It is certified that error appears in the above-identified patent and that said Letters Patent is hereby corrected as shown below: on the title page the assignee should read:

--(73) Assignee: W B Black & Sons (Holdings) Limited--

Signed and Sealed this

Eighth Day of August, 1989

*Attest:*

DONALD J. QUIGG

*Attesting Officer*

*Commissioner of Patents and Trademarks*